US006451128B1

(12) United States Patent
Lee et al.

(10) Patent No.: US 6,451,128 B1
(45) Date of Patent: Sep. 17, 2002

(54) METHOD FOR MANUFACTURING HIGH MAGNETIC FLUX DENSHY GRAIN ORIENTED ELECTRICAL STEEL SHEET BASED ON LOW TEMPERATURE SLAB HEATING METHOD

(75) Inventors: Chung San Lee; Chan Hye Han; Jong Soo Woo; Gyu Seung Choi; Jae Kwan Kim; Byung Deuk Hong; Kyu Seok Han, all of Kyungsangbook-do (KR)

(73) Assignee: Pohang Iron & Steel Co., Ltd. (KR)

( * ) Notice: Subject to any disclaimer, the term of this patent is extended or adjusted under 35 U.S.C. 154(b) by 0 days.

(21) Appl. No.: 09/242,865

(22) PCT Filed: Jun. 26, 1998

(86) PCT No.: PCT/KR98/00184

§ 371 (c)(1),
(2), (4) Date: Feb. 25, 1999

(87) PCT Pub. No.: WO99/02742

PCT Pub. Date: Jan. 21, 1999

(30) Foreign Application Priority Data

Jun. 27, 1997 (KR) ..... 97/28305
Aug. 4, 1997 (KR) ..... 97/37247

(51) Int. Cl.[7] ..... H01F 1/147
(52) U.S. Cl. ..... 148/111; 148/113
(58) Field of Search ..... 148/113, 111

(56) References Cited

U.S. PATENT DOCUMENTS 4,200,477 A * 4/1980 Datta et al. ..... 148/113
5,547,519 A 8/1996 Murphy ..... 148/113
5,653,821 A * 8/1997 Choi et al. ..... 148/111

FOREIGN PATENT DOCUMENTS

| | | |
|---|---|---|
| EP | 0334223 | 9/1989 |
| EP | 0709470 | 5/1996 |
| EP | 0743370 | 11/1996 |
| JP | 30-3651 | 5/1955 |
| JP | 40-15644 | 7/1965 |
| JP | 51-13469 | 4/1976 |
| JP | 1230721 | 9/1989 |
| JP | 1283324 | 11/1989 |
| JP | 2228425 | 9/1990 |
| JP | 2294428 | 12/1990 |
| JP | 02-294428 A * | 12/1990 |
| JP | 3002324 | 1/1991 |

* cited by examiner

*Primary Examiner*—George Wyszomierski
*Assistant Examiner*—Janelle Combs-Morillo
(74) *Attorney, Agent, or Firm*—Webb Ziesenheim Logsdon Orkin & Hanson, P.C.

(57) ABSTRACT

A method for manufacturing a high magnetic flux density grain oriented electrical steel sheet is disclosed. A silicon steel slab is heated and hot-rolled, and the steel sheet is annealed and cold-rolled and decarburized. An annealing separator is spread on the steel sheet, and a final high temperature annealing is carried out. The silicon steel contains in weight % 0.02–0.045% of C, 2.90–3.30% of Si, 0.05–0.30% of Mn, 0.005–0.019% of Al, 0.003–0.008% of N, 0.006% or less of S (the above being main ingredients), 0.001–0.012% of B, and a balance of Fe and unavoidable impurities; or the above main ingredients plus 0.30–0.70% of Cu, 0.03–0.07% of Ni, 0.03–0.07% of Cr, and a balance of Fe and unavoidable impurities; or the above main ingredients plus 0.001–0.012% of B, 0.30–0.70% of Cu, 0.03–0.07% of Ni, 0.03–0.07% of Cr, and a balance of Fe and unavoidable impurities.

22 Claims, No Drawings

METHOD FOR MANUFACTURING HIGH MAGNETIC FLUX DENSHY GRAIN ORIENTED ELECTRICAL STEEL SHEET BASED ON LOW TEMPERATURE SLAB HEATING METHOD

BACKGROUND OF THE INVENTION

1. Field of the Invention

The present invention relates to a method for manufacturing a grain oriented electrical steel sheet for use as iron cores of electric apparatuses such as transformers and the like. More specifically, the present invention relates to a method for manufacturing a high magnetic flux density grain oriented electrical steel sheet, in which inhibitors for restraining the growth of primary recrystallization grains are formed after a cold rolling is carried out to the final thickness, thereby making it possible to carry out a low temperature heating.

2. Description of the Prior Art

The grain oriented electrical steel sheet has a (110) [001] texture in the rolling direction. The method for this was first disclosed by N. P. Goss, and since that time, many researchers have made efforts to improve the method and the properties of the steel sheet. The magnetic properties of the grain oriented electrical steel sheet appear in the secondary recrystallization structure which is obtained by inhibiting the growth of the primary recrystallization grains and by selectively growing the (110) [001] crystal grains from among the inhibited crystal grains.

Therefore, if the grain oriented electrical steel sheet having superior magnetic properties is to be manufactured, it is important how the inhibitors are formed, and how the processes of obtaining a stable (110) [001] texture from among the inhibited grains are constituted.

Specifically, the inhibitors are formed by employing fine precipitates and segregated elements. The precipitates should be uniformly distributed in a sufficient amount and proper sizes, so that the growth of the primary recrystallization grains can be inhibited until the formation of the secondary recrystallization grains. Further, the precipitates should not be decomposed by being maintained in a thermally stable state up to the peak temperature immediately before the formation of the secondary recrystallization grains. The currently used inhibitors which satisfy the above conditions are MnS, MnS+AlN, MnS(Se)+Sb.

The technique of manufacturing the electrical steel sheet by using only MnS is disclosed in Japanese Patent Gazette Sho-40-15644. In this technique, a stable secondary recrystallization structure is obtained by carrying out two stages of cold rolling including an intermediate annealing. However, this method cannot obtain a high magnetic flux density, and the manufacturing cost is increased due to the fact that the two stages of cold rolling are carried out.

The typical technique of manufacturing the oriented electrical steel sheet by using MnS+AlN as the inhibitors are described in Japanese Patent Gazette Sho-30-3651. In this method, a single stage of cold rolling is carried out at a reduction rate of 80% or more, thereby obtaining a high magnetic flux density. However, if this method is applied to the industrial field, the manufacturing conditions are too stern, and therefore, the respective process conditions have to be strictly controlled.

Specifically, in this method, a high temperature slab heating, a hot rolling, a precipitation annealing, a cold rolling, a decarburization annealing and a high temperature annealing are carried out.

Here, the high temperature annealing refers to the process of developing the (110)[001] texture by making the secondary recrystallization occur in the final gauged sheet In any method using the inhibitor, an annealing separator is spread on the steel sheet before carrying out the high temperature annealing to prevent the sticking of the sheets, and during the decarburization, the oxide layer of the surface of the steel sheet reacts with the annealing separator to form a glass film, thereby providing an insulating property on the steel sheet. Thus, by the high temperature annealing, the final product of the steel sheet having the (110)[001] texture is provided with an insulating film on its surface.

The typical technique of manufacturing the grain oriented steel sheet by using MnS(Se)+Sb as the inhibitors are disclosed in Japanese Patent Gazette Sho-51-13469. In this method, a high temperature slab heating, a hot rolling, a precipitation annealing, a first cold rolling, an intermediate annealing, a second cold rolling, a decarburization annealing and a high temperature annealing are carried out. In this method, a high magnetic flux density can be obtained. However, two stages of cold rolling are carried out, and Sb or Se which is very expensive is used as the inhibitor. Therefore, the manufacturing cost is increased, and, still more, the production line shows to be toxic to the human body.

Further, in the above methods, the steel slab is heated at a high temperature for a long time to realize solid solutions of MnS or AlN before carrying out the hot rolling. Then during the cooling of the hot rolled sheet, MnS or AlN is formed into precipitates of proper size and distribution, thereby making it possible to use them as the inhibitor.

Specifically, in order to achieve a high magnetic flux density, it is known that a slab-heating has to be carried out up to 1300° C. in the method using MnS as the inhibitor, a slab-heating has to be carried out up to 1350° C. in the method using MnS and AlN as the inhibitor, and a slab-heating has to be carried out up to 1320° C. in the method using MnS(Se)+Sb as the inhibitor. Actually when it is applied to the industrial production, the heating has to be carried out up to 1400° C. to obtain a uniform temperature up to the inner regions of the slab.

In the case where the slab is heated to a high temperature for a long time, the consumed heat amount is large, and therefore, the manufacturing cost is increased. Further, the surface portions of the slab are melted down, with the result that the repair cost for the furnace is increased, and that the life expectancy of the furnace is shortened.

Particularly, if the columnar crystal (the solidified structure) of the slab surface is coarsely developed, then deep lateral cracks are formed during the later hot rolling. As a result, the yield is markedly decreased, and other problems may occur.

In order to solve the above described problems, if the slab-heating temperature is lowered when manufacturing the grain oriented steel sheet, then many advantages can be obtained in the manufacturing cost and the yield.

Therefore recently, research has been briskly carried out on the methods in which MnS requiring a high solid solution temperature is not used. That is, in these methods, the precipitates as the inhibitors are not formed by only the elements added in the steel making process, but the precipitates are formed at a proper stage during the manufacturing process.

The above methods are described in Japanese Patent Gazette Hei-1-230721 and Hei-1-283324 in which nitrogenization treatment is applied.

Belonging to this category, the following can be cited. One is that in which an annealing separator containing a chemical agent capable of nitrogenization is spread on the steel sheet to nitrogenize the steel sheet. Another is that in which a gas capable of nitrogenization is put into the atmospheric gas during the heating stage of the high temperature annealing to nitrogenize the steel sheet. Still another is that in which the steel sheet is nitrogenized within an atmosphere capable of nitrogenization after the decarburization.

Japanese Patent Gazette Hei-2-228425 discloses a method in which precipitates are formed by putting nitrogen into the steel during a nitrogenization process carried out on the hot rolled steel sheet, or on the first cold rolled steel sheet.

Japanese Patent Gazette Hei-2-294428 discloses a method in which nitrogenization and decarburization are simultaneously carried out during a decarburization annealing after the cold rolling. In this method, (Al,Si)N is used as the inhibitor, and due to the nitrogenization which occurs simultaneously with the decarburization, (Al,Si)N are formed mainly on the grain boundaries of the surface layer, so that the growth of the primary recrystallization grains of the surface layer can be inhibited. Accordingly, the surface layers have fine primary recrystallization grains, while the internal regions have coarse recrystallization grains. As a result, the secondary recrystallization becomes unstable, and consequently, the magnetic flux density is lowered.

In an attempt to solve this problem, Japanese Patent Gazette Hei-3-2324 discloses a method in which first the decarburization annealing is carried out, and after the growth of the grains to a certain size (about 15 $\mu$m), a nitrogenization is carried out by using ammonia gas during an additional decarburization annealing.

In these methods, the nitrogen which is produced during the decomposition of ammonia at above 500° C. is put on the steel sheet.

The nitrogen which has intruded into the steel sheet reacts with the surrounding Al and Si to form nitrides, and these nitrides are utilized as the inhibitor. The inhibitors in this case are mainly Al nitrides such as AlN and (Al,Si)N.

As described above, the methods in which the low temperature slab heating is carried out utilize the contained chemical agents capable of nitrogenization or the gas capable of nitrogenization, thereby realizing the nitrogenization. Thus precipitates are formed within the steel sheet so as to manufacture the grain oriented electrical steel sheet.

However, in all the methods, the steel sheet commonly contains about 0.050% of carbon, and thus the nitrogen can be put to the steel sheet after a decarburization. As a result, the additional subprocess becomes necessary. Particularly, in the method using the gas for nitrogenization, a new facility or a drastic modification of the existing facility has to be added. Further, in the method adding chemicals capable of nitrogenization to the annealing separator, large amounts of defects are generated in the surface forsterite layer.

Further, the amount of S or N within the steel is relatively high, and therefore, an unintended MnS or AlN is produced in large amounts after the hot rolling. After the decarburization, it causes the size of the primary recrystallization grains to be fine, and therefore, in order to achieve a stable secondary recrystallization, a very strong inhibitor is to be prepared. That is, fine precipitates have to be formed with uniform distribution. For this purpose, the sizes of the grains have to be controlled to a small range in a stern manner after the decarburization, and the amount of the nitrogenization has to be strictly controlled. Therefore, the industrial application becomes very difficult.

If the nitrogenization method is to be applied to the industrial field, the following two problems have to be solved primarily.

First, the process has to be improved without much modifying the existing facility. This is the economic aspect of the new method.

Second, a stable grain oriented electrical steel sheet should be able to be manufactured with a wide tolerance for the process control. This is related to the yield, and ultimately to the manufacturing cost.

SUMMARY OF THE INVENTION

In order to solve the above described problems of the conventional techniques, the present inventors carried out studies and research, and based on the results, the present inventors came to propose the present invention.

Therefore it is an object of the present invention to provide a method for manufacturing a grain oriented electrical steel sheet, in which a silicon steel slab having a lowered C content and a proper B content is reduced to the final thickness, and a nitrogenization is carried out at proper conditions to form BN precipitates, so that a low temperature heating for the slab will be possible, that the electrical steel sheet can be manufactured without modifying the existing facility, and that a uniform primary recrystallization structure can be obtained after the nitrogenization, thereby obtaining a high magnetic flux density.

It is another object of the present invention to provide a method for manufacturing a grain oriented electrical steel sheet, in which a silicon steel slab containing a lowered C amount and proper amounts of Cu, Cr and Ni is reduced to the final thickness, and nitrogenization is carried out at proper conditions to obtain a uniform primary recrystallization structure, so that a low temperature slab heating will be possible, and that the electrical steel sheet can be manufactured without modifying the existing facility, thereby obtaining a high magnetic flux density.

DETAILED DESCRIPTION OF THE PREFERRED EMBODIMENTS

The method for manufacturing a grain oriented electrical steel sheet having a high magnetic flux density according to the present invention includes the steps of: slab-heating and hot-rolling a silicon steel slab to form a hot-rolled steel sheet; annealing the hot-rolled steel sheet; cold-rolling the annealed steel sheet by a single stage to form a cold rolled steel sheet; decarburizing the cold rolled steel sheet; spreading an annealing separator on the decarburized steel sheet; and carrying out a final high temperature annealing, characterized in that: the silicon steel slab contains in weight % 0.02–0.045% of C, 2.90–3.30% of Si, 0.05–0.30% of Mn, 0.005–0.019% of Al, 0.003–0.008% of N, 0.006% or less of S, 0.30–0.70% of Cu, 0.03–0.07% of Ni, 0.03–0.07% of Cr, and a balance of Fe and other unavoidable impurities; the slab-heating temperature for the steel slab is 1050–1250° C.; and the decarburization process is carried out to decarburize and nitrogenize simultaneously at a temperature of 850–950° C. for 30 seconds to 10 minutes under a nitrogen-containing atmosphere having a dew point of 30–70° C., thereby achieving the low temperature heating method.

In another aspect of the present invention, the method for manufacturing a grain oriented electrical steel sheet having a high magnetic flux density according to the present invention includes the steps of: slab-heating and hot-rolling a silicon steel slab to form a hot-rolled steel sheet; annealing the hot-rolled steel sheet; cold-rolling the annealed steel sheet by a single stage to form a cold rolled steel sheet; decarburizing the cold rolled steel sheet; spreading an annealing separator on the decarburized steel sheet; and carrying out a final high temperature annealing, characterized in that: the silicon steel slab contains in weight % 0.02–0.045% of C, 2.90–3.30% of Si, 0.05–0.30% of Mn, 0.005–0.019% of Al, 0.001–0.012% of B, 0.003–0.008% of N, 0.006% or less of S, and a balance of Fe and other unavoidable impurities; the slab-heating temperature for the steel slab is 1050–1250° C.; and the decarburization is carried out to form BN precipitates and to carry out the decarburization simultaneously, thereby achieving a low temperature slab-heating method.

In still another aspect of the present invention, the method for manufacturing a grain oriented electrical steel sheet having a high magnetic flux density according to the present invention includes the steps of: slab-heating and hot-rolling a silicon steel slab to form a hot-rolled steel sheet; annealing the hot-rolled steel sheet; cold-rolling the annealed steel sheet by a single stage to form a cold rolled steel sheet; decarburizing the cold rolled steel sheet; spreading an annealing separator on the decarburized steel sheet; and carrying out a final high temperature annealing, characterized in that: the silicon steel slab contains in weight % 0.02–0.045% of C, 2.90–3.30% of Si, 0.05–0.30% of Mn, 0.001–0.012% of B, 0.005–0.019% of Al, 0.003–0.008% of N, 0.006% or less of S, 0.030–0.70% of Cu, 0.03–0.07% of Ni, 0.03–0.07% of Cr, and a balance of Fe and other unavoidable impurities; the slab-heating temperature for the steel slab is 1050–1250° C.; and the decarburization is carried out at a temperature of 850–950° C. for 30 seconds to 10 minutes under a nitrogen-containing atmosphere having a dew point of 30–70° C. so as to carry out decarburization and nitrogenization simultaneously, thereby achieving a low temperature slab-heating method.

Now the present invention will be described in further details.

First the grain oriented electrical steel sheet containing Cu, Ni and Cr will be described.

Generally, if the high magnetic flux density grain oriented electrical steel sheet containing 0.045–0.065% of C is decarburized and nitrogenized simultaneously, it is possible to attain a proper nitrogen-rich level. However, a sufficient decarburization does not occur within a short period of time, and therefore, control of the carbon content is needed.

However, if less C is added than normal, the microstructure of the hot rolled steel sheet becomes non-uniform. As a result, the microstructure of the primary recrystallization after the simultaneous decarburization-nitrogenization annealing becomes non-uniform. Therefore, even if the grain growth inhibiting force is prepared by forming a proper nitrogen-rich state, still the secondary recrystallization occurs unstably, with the result that a high magnetic flux density is not obtained.

In order to prevent the non-uniform distribution of the microstructure of the primary recrystallization grains due to the decrease of the C content, the present inventors carried out much research and experiments, and found the following fact. That is, if a proper nitrogen-rich level is realized in accordance with proper additions of Cu, Ni and Cr, a uniform primary recrystallization structure can be obtained.

In the silicon steel slab containing Cu, Ni and Cr, the reason for limiting their contents will be described.

If the steel slab contains less than 0.02% of C, then the grains grow too coarsely during the heating of the slab, with the result that the development of the secondary recrystallization becomes unstable during the final high temperature annealing, this being not desirable. On the other hand, if its content exceeds 0.045%, the simultaneous decarburization-nitrogenization annealing takes too much time. Therefore, it is desirable to limit the C content to 0.02–0.045%.

The element Si is a basic element of the electrical steel sheet, and it increases the resistivity of the material to lower the iron loss. If its content is less than 2.9%, the iron loss characteristics are aggravated. On the other hand, if its content exceeds 3.3%, the cold rollability is aggravated. Therefore, the Si content should be preferably limited to 2.9–3.3%.

The element Mn increases the resistivity to lower the iron loss. If its content is too high, the magnetic flux density is lowered, and therefore, the Mn content should be preferably limited to 0.05–0.3%.

In the conventional composition system, Al forms AlN and (Al,Si)N so as for them to act as the inhibitor. In the present invention, however, Al is meaningless in view of the inhibitor. However, Al increases the electrical resistivity like Si, and therefore, it is advantageous to add it up to 0.019%. However, above 0.019%, the hot rollability is aggravated.

Therefore, the Al content should be preferably limited to 0.005–0.019%.

In the conventional methods, in spite of the aggravation of the hot rollability, AlN has to be used as the inhibitor, and its addition was done up to 0.05%. In the present invention, however, such a need is eliminated.

As to N, if its content is less than 0.003%, then the amount of the inhibitors will be insufficient, while if its content is more than 0.008%, defects such as a blister may occur. Therefore, the N content should be preferably limited to 0.003–0.008%.

If S is excessively added, segregations become severe in the inner regions of the slab. If this is to be made even, the slab has to be heated above the defined temperature of the present invention. Therefore it is desirable to add S only up to 0.006%.

The elements Cu, Ni and Cr compensate the decrease of C to homogenize the microstructure of the hot rolled steel sheet. Further, they are important elements for making the primary recrystallization microstructure uniform after the simultaneous decarburization-nitrogenization annealing. Their contents should be preferably limited to 0.3–0.1%, 0.03–0.07% and 0.03–0.07% respectively.

If any one of them comes short of the above limit, the uniform microstructure realizing effect becomes insufficient for the primary recrystallization microstructure after the simultaneous decarburization-nitrogenization annealing, with the result that the secondary recrystallization becomes unstable, thereby aggravating the magnetic properties. On the other hand, if the upper limits of the above ranges are exceeded, their addition effects become rather insignificant. Particularly, in the case of the Cu and Cr, they make the decarburization difficult, while in the case of Ni, the expensive element causes the rise of the manufacturing cost.

In the above described steel slab, unavoidable impurities (B, Ti, Nb, V) which are introduced from the raw material of the steel may be tolerated up to 80 ppm.

Meanwhile, if P is contained more than the normal, then a sheet rupture during a cold rolling may be caused, and therefore, its content should be preferably limited to less than 0.015%. Up to this upper limit, it can be controlled without incurring much cost increase.

The above described silicon steel slab can be manufactured based on the general solution method, ingot making method and continuous casting method.

If the slab is too thin, the hot rolling productivity is lowered, while if it is too thick, the slab heating time is extended. Therefore, it should be preferably limited to 150–350 mm in thickness.

Now the method for manufacturing the grain oriented electrical steel sheet by using the above described silicon steel slab will be described.

The heating temperature for the silicon steel slab should be preferably 1050–1250° C., and the reason is as follows. That is, if the reheating temperature is below 1050° C., the workability during the hot rolling is aggravated, while if it is above 1250° C., then the advantages of the low heating are all lost, although the magnetic properties are not aggravated.

In the conventional methods using AlN or MnS as the inhibitor, AlN or MnS is subjected to a solid solution by a high temperature slab-heating, and they are reprecipitated during the hot rolling to adjust the size and the distribution. Therefore, in the conventional methods, the high temperature heating for the slabs was imperative. In the present invention, however, the inhibitor is formed after carrying out a cold rolling down to the final thickness, and therefore, the high temperature heating for the slab (for controlling the precipitates) is not required. Therefore, the slab heating temperature should be preferably limited to 1050–1250° C. by taking into account the hot rolling workability and the heating economy.

The slab-heating time period should be preferably limited to 1–10 hours by taking into account the economy and the uniform heating up to the inner regions of the slab.

The slab which has been heated in the above described manner is subjected to a hot rolling, and the hot rolling thickness should be preferably limited to 1.5–2.6 mm by taking into account a later cold rolling thickness.

After the hot rolling, a hot rolled sheet annealing is carried out. This hot rolled sheet annealing is carried out preferably at 900–1150° C. for 30 seconds to 10 minutes in view of the fact that the nitrides such as AlN partly formed during the hot rolling should be prevented from being coarsened, and that the primary recrystallization structure should have a proper size of grains after a later simultaneous decarburization-nitrogenization annealing. Here, in order to inhibit the loss of the precipitates, a nitrogen atmosphere should be preferably adopted.

If the annealing is too low in its temperature or if its duration is too short, then the primary recrystallization grains become too fine, and therefore, the complete secondary recrystallization cannot be achieved, with the result that a superior magnetic flux density cannot be obtained. On the other hand, if the temperature of the annealing is too high, or if the annealing time is too long, then the precipitates become too coarse, with the result that the secondary recrystallization becomes unstable, this being not desirable.

The annealed sheet is cold-rolled a single time, and the final thickness should be preferably 0.23–0.35 mm. The reason is as follows. That is, if the thickness is less than 0.23 mm, then the secondary recrystallization is not developed to an acceptable degree, while if it is more than 0.35 mm, then the eddy current is increased.

During the cold rolling, the reduction rate should be preferably 84–90%.

The cold rolled steel sheet is subjected to a simultaneous decarburization-nitrogenization annealing at a temperature of 850–950° C. for 30 seconds to 10 minutes under a nitrogen-containing atmosphere having a dew point of 30–70° C.

If the annealing temperature is below 850° C., or if the time is less than 30 seconds, then the decarburization and the formation of the nitrogen-rich state become insufficient. If it exceeds 950° C., the primary recrystallization structure is too coarsened, with the result that a superior magnetic flux density cannot be obtained. If the annealing time exceeds 10 minutes, economy is aggravated. Therefore, the annealing temperature and time should be preferably limited to 850–950° C. and 30 seconds to 10 minutes.

As to the annealing atmosphere, any nitrogen-containing gas to bring a nitrogen-rich state will be acceptable. However, an ammonia+hydrogen+nitrogen atmosphere will be preferable, because it is easily controllable as to the decarburization rate and the nitrogen-rich state.

If the dew point of the atmosphere is too low, the decarburization capability is reduced, so that the annealing time may have to be extended, this being not acceptable. If the dew point is too high, the sheet surface oxide layer is formed non-uniformly. Therefore, during a later high temperature annealing, the glass film becomes defective. Therefore, the dew point should be preferably limited to 30–70° C.

In the case where the ammonia+hydrogen+nitrogen atmosphere is used for the simultaneous decarburization-nitrogenization annealing, the amount of nitrogen introduced into the steel sheet is varied by the ammonia percentage, the annealing temperature and the annealing time, and this amount is properly controlled depending on the steel composition. Among the variables, the ammonia amount which gives the greatest influence should be preferably adjusted to 0.1–1.0% by taking into account the nitriding effect and the safety in case of gas leakage.

At the above described annealing conditions, the steel sheet is decarburized, and the decarburizing capability is decided by the partial pressure of hydrogen and the vapor pressure.

During the simultaneous decarburization-nitrogenization, the residual carbon amount should be maintained as low as 30 ppm. That is, if it exceeds 30 ppm, the orientation of the secondary recrystallization is aggravated during a later high temperature annealing, so that a superior magnetic flux density cannot be obtained. Further, when the steel sheet is used as a part of a transformer, a magnetic aging occurs to deteriorate the iron loss characteristics.

The nitrogen which is made rich during the simultaneous decarburization-nitrogenization annealing reacts with the excess soluble Al, B, Cu and Mn of the steel at a low temperature region during the high temperature annealing so as to form additional precipitates. The grain growth inhibition force is decided by the mentioned precipitates, i.e., their amount and size.

Therefore, in order to achieve a proper grain growth inhibition force, the total amount of N within the steel sheet is decided to come within a range of $130-82.9\times\{1+[Cu\% +10\times(Ni\% +Cr\%)]^2\}$ppm, in the case where B is not added. In the case where B, Cu, Ni and Cr are added, the total amount of N within the steel sheet is decided to come within a range of $125-82.9\times\{1+[Cu\% +10\times(Ni\% +Cr\%)]^2\}$ ppm.

That is, if the total amount of N is less than the lower limit, the amount of the precipitates becomes too small. As a result, the grain growth inhibition force becomes insufficient, and consequently, the secondary recrystallization becomes unstable. On the other hand, if the total amount of N exceeds $82.9\times\{1+[CuT+10\times(Ni\% +Cr\%)]^2\}$ ppm, then not only the primary recrystallization structure is formed non-uniformly, but also the precipitates are easily coarsened during a heating stage of the final high temperature annealing. Therefore, the grain growth inhibition force does not maintain up to the highest temperature, and consequently, the secondary recrystallization becomes unstable. As a result, a superior magnetic flux density cannot be obtained, this being not desirable. Under this condition, the upper limit of the total amount of N is decided by Cu, Ni and Cr, and the reason is that these elements act to achieve a uniform distribution of the primary recrystallization structure.

Meanwhile, the lower limit of the total amount of N is varied by B, and the reason is thought that BN among the precipitates formed after the simultaneous decarburization-nitrogenization annealing has the strongest inhibiting force. Accordingly, the minimum required amount of N can be lowered.

Meanwhile, the grain size of the primary recrystallization is decided by the size and the distribution of the precipitates formed after the nitrogenization. The proper grain size which suits for the proper inhibition force is about 20–30 $\mu$m.

After the simultaneous decarburization-nitrogenization, an annealing separator having a main ingredient MgO is spread on the steel sheet, and then a final high temperature annealing is carried out.

Specifically, the high temperature annealing consists of: a uniform heating stage for developing the secondary recrystallization structure; and a high temperature soaking stage for removing impurities.

The heating rate of the uniform heating stage is important, because the precipitates are re-arranged. If the heating rate is too fast, the secondary recrystallization becomes unstable, while if it is too slow, the annealing time is extended, thereby aggravating the economy. Therefore, the heating rate should be preferably 10–40° C./hr. The temperature is raised at the mentioned rate to 1150–1250° C., and then a soaking is carried out for 1–30 hours for a purification.

The atmosphere of the uniform heating stage should be preferably a nitrogen-containing gas for preventing the loss of N. Meanwhile, the atmosphere for the soaking stage should be preferably a hydrogen gas or a hydrogen-nitrogen mixed gas, for removing the residual impurities such as N and S after the formation of the glass film and the completion of the secondary recrystallization.

On the steel sheet on which the glass film has been formed during the high temperature annealing, there may be formed a tension reinforcing coating for improving the insulating property and the iron loss (by the magnetic domains refining).

Meanwhile, in the method for manufacturing the grain oriented electrical steel sheet by adding B, the content of B should be preferably limited to 0.001–0.012%.

First, B exists in a solid-dissolved state within the steel, and during the decarburization-nitrogenization annealing, B reacts with N introduced from the atmospheric gas to form BN precipitates so as to be used as the inhibitor. If the B content is less than 0.001%, the amount of the inhibitor becomes insufficient, with the result that a stable secondary recrystallization cannot be obtained. On the other hand, if it exceeds 0.012%, the magnetic flux density is lowered, although the secondary recrystallization is completed. Therefore, the content of B should be preferably limited to 0.001–0.012%.

Now the method for manufacturing the grain oriented electrical steel sheet by adding B will be described metallurgically as to the manufacturing process.

The silicon steel slab contains Si, Mn, B and Al, and therefore, after the nitrogenization, nitrides are formed singly or compositely.

The above elements will be compared thermodynamically as to their reaction priorities. First, AlN is formed, and then, BN nitride is formed. That is, when nitrides are formed at a high temperature, Al and N are thermodynamically compatible, and therefore, AlN is formed at an early stage. The AlN thus formed is very coarse, and it remains intact even after the hot rolling.

In the steel composition of the present invention, the N content is low i.e., below 0.008%, and therefore, other nitrides are almost negligible. Other precipitates which are observed in the hot rolled sheet are coarse MnS, and even these can be very rarely observed.

Meanwhile, a hot rolled sheet annealing is carried out at a relatively high temperature of 1120° C., so that AlN can be partially solid-dissolved to be reprecipitated. Then a quenching is carried out to form a relatively fine AlN, and this AlN could even be used as the inhibitor. However, in the present invention, a sufficient amount of inhibitor can be secured even without the above procedure, so that a superior magnetic flux density can be obtained.

That is, in the present invention, N is added during the simultaneous decarburization-nitrogenization annealing, so that BN will be formed. Even if the Al content in the silicon steel slab is high, and even if surplus Al remains, BN is primarily precipitated.

This can be clearly seen if it is thermodynamically observed.

The thermodynamic data on BN and AlN are found in Metallurgical Thermochemistry (5th edition, Kubaschewski, 1979). According to the data, the enthalpy of BN is higher than the enthalpy of AlN, and the free energy after considering the entropy is smaller in Al. This is meant that the formation of AlN is thermodynamically easier than that of BN. In spite of this fact, BN is actually preferentially formed, and the reason is as follows.

When pure B and pure Al are made to react to form nitrides, AlN is preferentially formed. However, in the case where B and Al coexist within Fe in a solid soluble state, if N is put to form nitrides, then the situation becomes different. That is, when B and Al coexisting within ferrite-Fe react with N within ferrite-Fe, BN is preferentially formed.

This can be explained based on thermodynamic speed theory, and it owes to the difference of diffusion coefficients.

This phenomenon has been proven by many studies including the Yamanakil's report to Trans. Iron. Steel. Inst. Jpn (1978, 1, 8, p404–411).

According to the research report of Yamanaki, the diffusion speed of B within Fe is very fast and as fast as N. Therefore, even when carrying out a quenching or a coiling at a very low temperature, BN is formed.

In contrast to this, the diffusion speed of Al within ferrite-Fe is very slow compared with B.

Thus the reaction speed of certain solid-dissolved elements within Fe is decided by the diffusion speed of the solid-dissolved elements.

The present inventors also observed the precipitations after carrying out the simultaneous decarburization-nitrogenization annealing of the B containing silicon steel, and found that a large amount of BN had been formed.

The size of BN is several hundred Å, and its shape is triangular or quadragonal having different edge lengths.

The observed BN has a cubic structure having an interfacial distance of 1.2875 Å, and this corresponds to the known JCPDS25-1033. other compounds such as MnS, (Si,Mn)N, and AlN were also observed in our specimens. MnS was coarse and might be existing from the hot rolling. (Si,Mn)N is thought to be formed after the nitrogenization, and AlN is thought to be formed finely after the hot rolled sheet annealing. However, all of them were negligible in amounts. The main precipitates in the present invention are BN, and this nitride acts as the inhibitor.

Until now, the addition of B has been thought to serve a supplementary role for AlN and MnS, but the use of Bn as the main inhibitor has not been reported.

In the case of Al having a slow diffusion coefficient compared with B, the AlN which is formed during the decarburization-nitrogenization annealing precipitates mainly on the grain boundaries of the surface layer. Therefore, a non-uniform primary recrystallization structure is formed, and consequently, secondary recrystallization becomes unstable. On the other hand, in the case of B, since the diffusion speed is very fast, BN is uniformly distributed not only in the surface layer but also in the inner regions. Therefore, a uniform primary recrystallization structure can be obtained after the decarburization-nitrogenization annealing, and therefore, a stable secondary recrystallization can be achieved.

By using the BN as main inhibitor, the present inventors could confirm the possibility of manufacturing a grain oriented electrical steel sheet having superior magnetic properties.

Meanwhile, in the case where the electrical steel sheet is manufactured by using a silicon steel slab containing Cu, Ni, Cr and B, not only the advantage of using the BN as inhibitor can be utilized but also the primary recrystallization structure is more uniform compared with the case of containing only Cu, Ni and Cr, or containing only B, and therefore, a stable secondary recrystallization can be obtained, thereby improving the magnetic flux density.

Now the present invention will be described based on actual examples.

<Example 1>

Steel slabs were prepared, and the slabs contained 30 in weight %: 0.019% of C, 3.20% of Si, 0.24% of Mn, 0.018% of soluble Al, 0.0055% of N, 0.005% of S, 0.015% of P, and a balance of Fe, with Cu, Ni and Cr being varied as shown in Table 1 below. The thickness of the slab was 250 mm. This slab was heated at a temperature of 1150° C. for 4 hours and 30 minutes, and was hot-rolled to a thickness of 2.0 mm. Then hot-rolled sheet annealing was carried out at 950° C. for 3 minutes, and then it was pickled. Then a single stage of cold rolling was carried out to the final thickness of 0.285 mm. Thereafter, a simultaneous decarburization-nitrogenization was carried out at 900° C. for 3 minutes under a humid ammonia+hydrogen +nitrogen mixed atmosphere having a dew point of 45° C.

Here, in order to vary the total N amount as shown in Table 1 below, a mixed atmospheric gas was used. That is, in the atmospheric gas, ammonia ($NH_3$) was varied within a range of 0.05–10 vol %, and hydrogen ($H_2$) was varied within a range of 5–80 vol %, the rest being composed of $N_2$. Then an annealing separator having a main ingredient MgO was spread on the steel sheet, and then, a final high temperature annealing was carried out. The final high temperature annealing was carried out in the following manner. That is, the temperature was raised up to 1200° C. at a rate of 20° C./hr for realizing the secondary recrystallization, and then, a soaking was carried out for 15 hours, before cooling it. During the heating stage, the atmospheric gas was 25% $N_2$+75% $H_2$. After attaining to 1200° C., the atmospheric gas was changed to pure hydrogen.

For the specimens which were made by varying the contents of Cu, Ni, Cr and N in the above described manner, there were measured the residual C, the total amount of N, the uniformness of the fine primary recrystallization structure, the development of the secondary recrystallization, and the magnetic flux density. The measured results are shown in Table 1 below.

Here, the uniformness of the fine primary recrystallization structure was judged by observing the cross section of the simultaneous decarburization-nitrogenization annealed specimens by means of an optical microscope and an image analyzer after polishing and etching them by a 3%-nital, and the standard of the judgement was a grain size distribution. If the grain size distribution of the specimens is normal distribution type, then it was judged to be uniform, and otherwise (i.e., bimodal distribution type), it was judged to be non-uniform. The development of the secondary recrystallization was evaluated by etching the surfaces of the specimens by a 20% chloric acid solution heated to 80° C. and by observing the exposed macrostructure.

Further, the magnetic flux density was evaluated by measuring the flux density which was induced by a magnetizing force of $B_{10}$(1000 A/m) by means of a single sheet magnetic measuring instrument.

TABLE 1

| classification | alloy metals addition (wt %) Cu | Ni | Cr | optimum N range (ppm) | atmospheric gas (vol %) $NH_3$ | $H_2$ | total N after D-N annealing | residual C (ppm) | uniformness of primary recrystallization structure | Development of secondary recrystallization (%) | flux density $B_{10}$ (Tesla) |
|---|---|---|---|---|---|---|---|---|---|---|---|
| comparative material 1 | 0.5 | 0.05 | 0.05 | 130~269 | 0.05 | 5 | 120* | 25 | uniform | 95* | 1.87* |
| inventive material 1 | 0.5 | 0.05 | 0.05 | 130~269 | 0.5 | 25 | 219 | 23 | uniform | 100 | 1.94 |
| inventive material 2 | 0.5 | 0.05 | 0.05 | 130~269 | 0.7 | 25 | 267 | 21 | uniform | 100 | 1.94 |
| inventive material 3 | 0.5 | 0.05 | 0.05 | 130~269 | 0.6 | 25 | 235 | 18 | uniform | 100 | 1.95 |
| comparative material 2 | 0.5 | 0.05 | 0.05 | 130~269 | 0.08 | 5 | 280* | 13 | non-uniform* | 80* | 1.75* |
| inventive material 4 | 0.4 | 0.06 | 0.07 | 130~322 | 1.0 | 10 | 311 | 16 | uniform | 100 | 1.93 |
| inventive material 5 | 0.6 | 0.03 | 0.04 | 130~223 | 0.5 | 35 | 204 | 21 | uniform | 100 | 1.94 |
| inventive material 6 | 0.5 | 0.04 | 0.04 | 130~223 | 0.5 | 25 | 220 | 24 | uniform | 100 | 1.96 |
| comparative material 3 | 0.3 | 0.03 | 0.03 | 130~150 | 0.07 | 25 | 125* | 26 | uniform | 75* | 1.77* |
| inventive material 7 | 0.3 | 0.03 | 0.03 | 130~150 | 0.1 | 50 | 150 | 23 | uniform | 100 | 1.91 |
| comparative material 4 | 0.3 | 0.03 | 0.03 | 130~150 | 0.09 | 25 | 162* | 21 | non-uniform* | 95* | 1.87* |
| comparative material 5 | 0.7 | 0.07 | 0.07 | 130~449 | 0.07 | 20 | 123* | 28 | uniform | 70* | 1.72* |
| inventive material 8 | 0.7 | 0.07 | 0.07 | 130~449 | 1.0 | 5 | 440 | 12 | uniform | 100 | 1.95 |
| comparative material 6 | 0.7 | 0.07 | 0.07 | 130~449 | 10 | 80 | 464* | 11 | non-uniform* | 90* | 1.88* |

TABLE 1-continued

| classification | alloy metals addition (wt %) Cu | Ni | Cr | optimum N range (ppm) | atmospheric gas (vol %) $NH_3$ | $H_2$ | total N after D-N annealing | residual C (ppm) | uniformness of primary recrystallization structure | Development of secondary recrystallization (%) | flux density $B_{10}$ (Tesla) |
|---|---|---|---|---|---|---|---|---|---|---|---|
| comparative material 7 | 0.2* | 0.07 | 0.07 | 130~295 | 0.08 | 5 | 280 | 21 | non-uniform* | 85* | 1.80* |
| comparative material 8 | 0.5 | 0.02* | 0.05 | 130~202 | 1.5 | 80 | 185 | 18 | non-uniform* | 85* | 1.81* |
| comparative material 9 | 0.5 | 0.06 | 0.02* | 130~223 | 2 | 80 | 213 | 17 | non-uniform* | 90* | 1.87* |
| comparative material 10 | non-addition | non-addition | 0.05 | — | 2 | 80 | 220 | 16 | non-uniform* | 90* | 1.86* |
| comparative material 11 | 0.8* | 0.04 | 0.04 | 130~295 | 5 | 80 | 290 | 44* | uniform | 100 | 1.85* |
| comparative material 12 | 0.5 | 0.04 | 0.08* | 130~322 | 5 | 70 | 305 | 45* | uniform | 100 | 1.83* |

*indicates cases where the conditions of the present invention are not conformed.

As shown in Table 1 above, Inventive materials 1–8 were manufactured in the following manner. That is, Cu, Ni and Cr were made to come within the range of the present invention as shown in table 1. Further, the total N content was controlled to the range of the present invention, i.e., $130-82.9\{1+[Cu\ \%\ +10\times(Ni\%\ +Cr\%)]^2\}$ ppm. In these Inventive materials, a uniform primary recrystallization structure and adequate AlN precipitates were obtained, and the secondary recrystallization was almost perfect, and consequently the magnetic flux density was high owing to the superior orientation.

Meanwhile, in the case of the comparative materials 1, 3 and 5 in which the total N contents were less than 130 ppm, an adequate amount of the grain growth inhibitor could not be obtained, and therefore, the secondary recrystallization was imperfect, with the result that the magnetic flux density was aggravated.

Further, in the cases of the comparative materials 7–10 in which the total N content was controlled to the range of the present invention but any one of Cu, Ni and Cr departed from the lower limit of the ranges of the present invention, the primary recrystallization was non-uniform, and therefore, the secondary recrystallization was unstable, with the result that the magnetic flux density was aggravated.

In the cases of the comparative materials 11 and 12 in which Cu and Cr exceeded the ranges of the present invention, although the secondary recrystallization was perfect, the decarburization was unacceptable (the residual C exceeding 30 ppm), and the orientation was aggravated, with the result that the magnetic flux density was lowered.

<Example 2>

Silicon steel slabs were prepared, and the slabs contained in weight %: 3.15% of Si, 0.013% of Al, 0.031% of C, 0.09% of Mn, 0.0065% of Mn, 0.006% of S and a balance of Fe and other unavoidable impurities, the content of B being varied as shown in Table 2 below. The steel slabs were heated at 1200° C. for 3 hours, and were hot-rolled to a thickness of 2.3 mm. The hot rolled steel sheets were annealed at 1120° C. for two minutes, and were subjected to a quenching by water of 100° C. Then a pickling was carried out, and then a cold rolling was carried out to a thickness of 0.30 mm.

For the cold rolled sheets, a simultaneous decarburization-nitrogenization annealing was carried out at 850° C. for 165 seconds under a mixed atmosphere containing wet 25% $H_2$+75% $N_2$ (having a dew point of 48° C.) and a dry $NH_3$ gas. The content of $NH_3$ gas was 0.3 vol %. Then an annealing separator MgO was spread, and then, a final high temperature annealing was carried out. During the annealing, the temperature was raised up to 1200° C. at a rising rate of 15° C./hr under an atmosphere of 25% $N_2$+75% $H_2$. At 1200° C., the temperature was maintained for 10 hours under a 100% $H_2$ atmosphere.

Thereafter, for the specimens in which the B contents were varied, there were inspected the uniformness of the fine primary recrystallization structure after the simultaneous decarburization-nitrogenization annealing, the development of the secondary recrystallization, and the magnetic flux density.

TABLE 2

| classification | amount of B (wt %) | uniformness of primary recrystallization structure | Development of recrystallization (%) | $B_{10}$ (Tesla) |
|---|---|---|---|---|
| comparative material 13 | non-addition | non-uniform | 70 | 1.61 |
| inventive material 9 | 0.0011 | uniform | 100 | 1.91 |
| inventive material 10 | 0.0033 | uniform | 100 | 1.92 |
| inventive material 11 | 0.0041 | uniform | 100 | 1.94 |
| inventive material 12 | 0.0080 | uniform | 100 | 1.92 |
| inventive material 13 | 0.0110 | uniform | 100 | 1.91 |
| comparative material 14 | 0.0130 | uniform | 100 | 1.86 |

As shown in Table 2 above, in the case of Comparative material 13 in which B was not added, not only the inhibiting force was insufficient, but also the fine primary recrystallization structure was non-uniform. Therefore, the secondary recrystallization was unstable, and therefore, the magnetic flux density was aggravated.

On the other hand, in the cases of Inventive materials 9–13 in which the B contents came within the range of the present invention, a uniform primary recrystallization structure was obtained, and proper amount and size of BN precipitates were observed. Therefore, not only the secondary recrystallization was perfect, but also the magnetic flux density was superior.

However, in the case of Comparative material 14 in which the B content exceeds the range of the present invention, although the secondary recrystallization was perfect, the orientation was deteriorated, with the result that the magnetic flux density was lowered.

<Example 3>

Silicon steel slabs were prepared, and the slabs contained in weight %: 3.10% of Si, 0.014% of Al, 0.10% of Mn, 0.0041% of B, 0.0032% of N, 0.0044% of S, and a balance of Fe and other unavoidable impurities, the content of C being varied as shown in Table 3 below. Then the slabs were heated at 1150° C. for 3 hours, and a hot rolling was carried out to a thickness of 2.3 mm. Then an annealing was carried out at 1120° C. for 2 minutes, and then, a quenching was carried out in water of 100° C. Then a pickling was carried out, and a cold rolling was carried out to a thickness of 0.30 mm.

After the cold rolling, a simultaneous decarburization-nitrogenization was carried out at 875° C. for 155 seconds under a mixed atmosphere containing wet 25% $H_2$+75% $N_2$ (having a dew point of 50° C.) and a dry $NH_3$ gas. The content of $NH_3$ was 0.3 vol %. Then an annealing separator MgO was spread on the steel sheets, and a final high temperature annealing was carried out by raising the temperature up to 1200° C. at a rising rate of 15° C./hr under a 25% $N_2$+75% $H_2$ atmosphere, and by maintaining at 1200° C. for 10 hours under a 100% $H_2$ atmosphere.

Thereafter, the residual C amount after the simultaneous decarburization-nitrogenization annealing, the amount of N, and the magnetic flux density were measured, and the measured results are shown in Table 3 below.

TABLE 3

| classification | C content (wt %) | residual C (ppm) | N content (ppm) | $B_{10}$ (Tesla) |
|---|---|---|---|---|
| comparative material 15 | 0.015 | 11 | 210 | 1.83 |
| inventive material 14 | 0.020 | 14 | 200 | 1.91 |
| inventive material 15 | 0.045 | 19 | 190 | 1.94 |
| comparative material 16 | 0.050 | 31 | 190 | 1.90 |
| comparative material 17 | 0.059 | 33 | 210 | 1.91 |

As shown in Table 3 above, a high magnetic flux density could be obtained only if the C content was more than 0.020% (Inventive materials 14–15, and Comparative materials 16–17). However, in the case of Comparative materials 16 and 17 having a C content of more than 0.05%, the residual C amount after the simultaneous decarburization-nitrogenization was more than 30 ppm, and therefore, if the materials were used on transformers, a magnetic aging would occur to aggravate the magnetic properties. Therefore it is seen that the C content should be preferably limited to 0.020–0.045%.

<Example 4>

Silicon steel slabs were prepared, and the slabs contained in weight %: 3.1% of Si, 0.034% of C, 0.14% of Mn, 0.0033% of B, 0.0060% of N, 0.0052% of S, and a balance of Fe and other unavoidable impurities, with the content of Al being varied as shown in Table 4 below. These slabs were heated at 1200° C. for 2 hours, and a hot rolling was carried out to a thickness of 2.3 mm. Then an annealing was carried out at a temperature of 1120° C. for 2 minutes, and then an air cooling was carried out. Then a pickling was carried out, and then, a cold rolling was carried out to a thickness of 0.27 mm.

After the cold rolling, a simultaneous decarburization-nitrogenization was carried out for 120 seconds under a mixed atmosphere containing wet 25% $H_2$+75% $N_2$(having a dew point of 50° C.) and a dry $NH_3$ gas. The content of $NH_3$ was 0.3 vol %. Here, the simultaneous decarburization-nitrogenization annealing was carried out at two temperatures separately, i.e., at 875° C. and 925° C.

Then an annealing separator MgO was spread on the steel sheets, and a final high temperature annealing was carried out by raising the temperature up to 1200° C. at a rising rate of 20° C./hr under a 25% $N_2$+75% $H_2$ atmosphere, and by maintaining at 1200° C. for 10 hours under a 100% $H_2$ atmosphere.

Thereafter, the magnetic properties were measured for each variation of the Al content and for each variation of the temperature of the simultaneous decarburization-nitrogenization annealing. Here, the iron loss was measured based on 50 Hz and 1.7 Tesla.

TABLE 4

| classification | Al content (wt %) | D-N annealing temperature (° C.) | $W_{17/50}$ (w/kg) | $B_{10}$ (Tesla) |
|---|---|---|---|---|
| inventive material 16 | 0.011 | 875 | 0.94 | 1.93 |
| inventive material 17 | 0.014 | | 0.97 | 1.94 |
| inventive material 18 | 0.019 | | 0.99 | 1.93 |
| inventive material 18 | 0.022 | | 1.33 | 1.87 |
| inventive material 19 | 0.011 | 925 | 0.96 | 1.92 |
| inventive material 20 | 0.014 | | 1.01 | 1.93 |
| inventive material 21 | 0.019 | | 1.01 | 1.93 |
| inventive material 19 | 0.022 | | 1.29 | 1.90 |

As shown in Table 4 above, in the case of Comparative materials 18 and 19 having an Al content of 0.022%, if the temperature of the simultaneous decarburization-nitrogenization was raised, then the magnetic flux density was slightly improved. However, the primary recrystallization structure became non-uniform, and therefore, the secondary recrystallization became unstable, with the result that fine grains remained. As a result, the iron loss became deteriorated.

<Example 5>

A silicon steel slab was prepared, and the slab contained in weight %: 3.15% of Si, 0.031% of C, 0.013% of Al, 0.09% of Mn, 0.0033% of B, 0.0065% of N, 0.006% of S, and a balance of Fe and other unavoidable impurities. This slab was heated at 1250° C. for 3 hours, and a hot rolling was carried out to a thickness of 0 2.3 mm. Then an annealing was carried out at a temperature of 1120° C. for 2 minutes, and then two kinds of coolings were carried out at the conditions set forth in Table 5 below. Then a pickling was carried out, and then, a cold rolling was carried out to a thickness of 0.30 mm.

After the cold rolling, a simultaneous decarburization-nitrogenization was carried out at 875° C. for 155 seconds under a mixed atmosphere containing wet 25% $H_2$+75% $N_2$(having a dew point of 63° C.) and a dry $NH_3$ gas. The content of $NH_3$ was 0.3 vol %.

Then an annealing separator MgO was spread on the steel sheets, and a final high temperature annealing was carried out by raising the temperature up to 1200° C. at a rising rate of 15° C./hr under a 25% $N_2$+75% $H_2$ atmosphere, and by maintaining at 1200° C. for 10 hours under a 100% $H_2$ atmosphere.

TABLE 5

| classification | cooling conditions | $W_{17/50}$ (w/kg) | $B_{10}$ (Tesla) |
|---|---|---|---|
| inventive material 22 | quenched in water of 100° C. | 1.04 | 1.93 |
| inventive material 23 | air-cooled | 1.03 | 1.94 |

As shown in Table 5 above, the steel sheets which were obtained at different cooling conditions after the hot rolled sheet annealing did not show much difference in the magnetic properties, but the magnetic properties were slightly superior in the case of air cooling.

<Example 6>

A silicon steel slab was prepared, and the slab contained in weight %: 3.15% of Si, 0.031% of C, 0.013% of Al, 0.09% of Mn, 0.0033% of B, 0.0065% of N, 0.006% of S, and a balance of Fe and other unavoidable impurities. This slab was heated at 1200° C. for 2 hours , and a hot rolling was carried out to a thickness of 2.3 mm. Then an annealing was carried out at a temperature of 1120° C. for 2 minutes, and then a quenching was carried out in water of 100° C. Then a pickling was carried out, and then, a cold rolling was carried out to a thicknesses of 0.23 mm, 0.27 mm, 0.30 mm and 0.35 mm.

After the cold rolling, a simultaneous decarburization-nitrogenization was carried out at 875° C. for 155 seconds under a mixed atmosphere containing wet 25% $H_2$+75% $N_2$(having a dew point of 63° C.) and a dry $NH_3$ gas. The content of $NH_3$ was 0.3 vol %.

Then an annealing separator MgO was spread on the steel sheets, and a finish high temperature annealing was carried out by raising the temperature up to 1200° C. at a rising rate of 15° C,/hr under a 25% $N_2$+75% $H_2$ atmosphere, and by maintaining at 1200° C. for 10 hours under a 100% $H_2$ atmosphere. Then magnetic properties were measured for each cold rolling reduction rate, and the results are shown in Table 6 below.

TABLE 6

| classification | final thickness (mm) | cold rolling reduction rate (%) | $W_{17/50}$ (w/kg) | $B_{10}$ (Tesla) |
|---|---|---|---|---|
| inventive material 24 | 0.35 | 84.8 | 1.93 | 1.09 |
| inventive material 25 | 0.30 | 87 | 1.93 | 1.04 |
| inventive material 26 | 0.27 | 88.3 | 1.94 | 0.92 |
| inventive material 27 | 0.23 | 90 | 1.94 | 0.83 |

As shown in Table 6 above, if the cold rolling reduction rate comes within the range of 84–90%, the magnetic properties were superior.

<Example 7>

A silicon steel slab was prepared, and the slab contained in weight %: 3.10% of Si, 0.036% of C, 0.014% of Al, 0.10% of Mn, 0.0033% of B. 0.0036% of N, 0.0052% of S, and a balance of Fe and other unavoidable impurities. This slab was heated at 1200° C. for 2 hours, and a hot rolling was carried out to a thickness of 2.3 mm. Then an annealing was carried out at a temperature of 900° C. for 2 minutes, and then an air cooling was carried out. Then a pickling was carried out, and then, a cold rolling was carried out to a thicknesses of 0.30 mm.

After the cold rolling, a simultaneous decarburization-nitrogenization was carried out for 120 seconds under a mixed atmosphere containing wet 25% $H_2$+75% $N_2$(having a dew point of 48° C.) and a dry $NH_3$ gas. The content of $NH_3$ was 0.3 vol %. The annealing temperature was varied within the range of 825–975° C. as shown in Table 7 below.

Then an annealing separator MgO was spread on the steel sheets, and a final high temperature annealing was carried out by raising the temperature up to 1200° C. at a rising rate of 15° C./hr under a 25% $N_2$+75% $H_2$ atmosphere, and by maintaining at 1200° C. for 10 hours under a 100% $H_2$ atmosphere. Then the N content and the magnetic properties after the final high temperature annealing were measured for each variation of the annealing temperature, and the results are shown in Table 7 below.

TABLE 7

| classification | D-N annealing temperature (° C.) | N content (ppm) | $B_{10}$ (Tesla) |
|---|---|---|---|
| comparative material 20 | 825 | 110 | 1.80 |
| inventive material 28 | 850 | 170 | 1.93 |
| inventive material 29 | 875 | 210 | 1.92 |
| inventive material 30 | 900 | 240 | 1.95 |
| inventive material 31 | 950 | 290 | 1.93 |
| comparative material 21 | 975 | 340 | 1.89 |

As shown in Table 7 above, the magnetic flux densities were significantly low in Comparative materials 20 and 21 in which the simultaneous decarburization-nitrogenization annealing were carried out at 825° C. and 975° C. respectively. This can be interpreted that if the annealing temperature is lower than 850° C., the N content of the steel is too low to obtain the inhibitor enough for the secondary recrystallization. Further, if the annealing temperature is too high, the primary recrystallization grains become non-uniform. As a result, the magnetic flux density is lowered.

<Example 5>

A silicon steel slab same as that of Example 7 was prepared. This slab was heated at 1250° C. for 2 hours, and a hot rolling was carried out to a thickness of 2.3 mm. Then an annealing was carried out at a temperature of 900° C. for 2 minutes, and then an air cooling was carried out. Then a pickling was carried out, and then, a cold rolling was carried out to a thicknesses of 0.30 mm.

After the cold rolling, a simultaneous decarburization-nitrogenization was carried out at 850° C. for 120 seconds under a mixed atmosphere containing wet 25% $H_2$+75% $N_2$(having a dew point of 48° C.) and a dry NH3 gas. The content of $NH_3$ was varied within a range of 0.05–1.5 vol % as shown in Table 8 below.

Then an annealing separator MgO was spread on the steel sheets, and a final high temperature annealing was carried out by raising the temperature up to 1200° C. at a rising rate of 15° C./hr under a 25% $N_2$+75% $H_2$ atmosphere, and by maintaining at 1200° C. for 10 hours under a 100% $H_2$ atmosphere. Then the N content and the magnetic properties after the final high temperature annealing were measured for each variation of the $NH_3$ amount, and the results are shown in Table 8 below.

TABLE 8

| classification | $NH_3$ vol (%) | N content (ppm) | $B_{10}$ (Tesla) |
|---|---|---|---|
| comparative material 22 | 0.05 | 90 | 1.81 |
| inventive material 32 | 0.1 | 170 | 1.92 |
| inventive material 33 | 0.5 | 220 | 1.95 |
| inventive material 34 | 1.0 | 290 | 1.94 |
| inventive material 23 | 1.5 | 380 | 1.89 |

As shown in Table 8 above, if the $NH_3$ vol % was too low (Comparative material 22), a sufficient nitrogenization could not be secured, and therefore, the magnetic properties were aggravated. On the other hand, if the $NH_3$ vol % was too high (Comparative material 23), the N content became too high, with the result that the magnetic induction was deteriorated.

<Example 9>

Silicon steel slabs were prepared, and the slabs contained in weight %: 3.15% of Si, 0.013% of Al, 0.031% of C, 0.10% of Mn, 0.0065% of N, 0.006% of Sr 0.5% of Cu, 0.05% of Ni, 0.05% of Cr. and a balance of Fe and other unavoidable impurities, with the B content being varied as shown in Table 9 below.

The slabs were at 1200° C. for 2 hours, and a hot rolling was carried out to a thickness of 2.3 mm. Then an annealing was carried out at a temperature of 1120° C. for 2 minutes, and then a quenching was carried out in water of 100° C. Then a pickling was carried out, and then, a cold rolling was carried out to a thicknesses of 0.30 mm.

After the cold rolling, a simultaneous decarburization-nitrogenization annealing was carried out at 850° C. for 185 seconds under a mixed atmosphere containing wet 25% $H_2$+75% $N_2$ (having a dew point of 52° C.) and a dry $NH_3$ gas. The content of $NH_3$ was 0.7 vol %.

Then an annealing separator MgO was spread on the steel sheets, and a final high temperature annealing was carried out by raising the temperature up to 1200° C. at a rising rate of 15° C./hr under a 25% $N_2$+75% $H_2$ atmosphere, and by maintaining at 1200° C. for 10 hours under a $10^6$% $H_2$ atmosphere. Then the magnetic properties for the specimens were measured, and the results are shown in Table 9 below.

TABLE 9

| classification | B content (wt %) | $B_{10}$ (Tesla) |
|---|---|---|
| inventive material 35 | 0.0010 | 1.94 |
| inventive material 36 | 0.0032 | 1.95 |
| inventive material 37 | 0.0040 | 1.97 |
| inventive material 38 | 0.0056 | 1.96 |
| inventive material 39 | 0.0110 | 1.94 |
| comparative material 24 | 0.0128 | 1.88 |

As shown in Table 9 above, inventive materials 35–39 containing Cu, Ni, Cr and B show the superior magnetic flux densities compared with the case where only B was added (inventive materials 9–13 in example 2). Even if Cu,. Ni, Cr. and B were added together,. if the B content was departed (Comparative material 24), the magnetic flux density was lowered.

<Example 10>

Silicon steel slabs were prepared, and the slabs contained in weight %: 3.10% of Si, 0.014% of Al, 0.10% of Mn, 0.0041% of B, 0.0028% of N, 0.0044% of S, 0.5% of Cu, 0.05% of Ni, 0.05% of Cr, and a balance of Fe and other unavoidable impurities, with the C content being varied as shown in Table 10 below.

The slabs were heated at 1150° C. for 2 hours, and a hot rolling was carried out to a thickness of 2.3 mm. Then an annealing was carried out at a temperature of 1120° C. for 2 minutes, and then a quenching was carried out in water of 100° C. Then a pickling was carried out, and then, a cold rolling was carried out to a thicknesses of 0.30 mm.

After the cold rolling, a simultaneous decarburization-nitrogenization annealing was carried out at 875° C. for 155 seconds under a mixed atmosphere containing wet 25% $H_2$+75% $N_2$ (having a dew point of 50° C.) and a dry $NH_3$ gas. The content of $NH_3$ was 0.7 vol %.

Then an annealing separator MgO was spread on the steel sheets, and a final high temperature annealing was carried out by raising the temperature up to 1200° C. at a rising rate of 15° C./hr under a 25% $N_2$+75% Hz atmosphere, and by maintaining at 1200° C. for 10 hours under a 100% $H_2$ atmosphere. Then the residual C contents and the residual N contents after the simultaneous decarburization-nitrogenization annealing were measured, the magnetic properties of specimens were measured, and the results are shown in Table 10 below.

TABLE 10

| classification | C addition (wt %) | residual C (ppm) | N content (ppm) | $B_{10}$ (Tesla) |
|---|---|---|---|---|
| comparative material 25 | 0.015 | 11 | 210 | 1.85 |
| inventive material 40 | 0.020 | 14 | 200 | 1.94 |
| inventive material 41 | 0.035 | 19 | 190 | 1.97 |
| inventive material 42 | 0.040 | 31 | 190 | 1.95 |
| comparative material 26 | 0.050 | 33 | 210 | 1.92 |

As shown in Table 10 above, it is seen that if Cu, Ni, Cr and B were added together, then the magnetic flux density was achieved. But, even if Cu, Ni, Cr and B were added together, if the C content falls short of the range of the present invention, then the magnetic flux density was deteriorated.

In the case where the C content was more than 0.020%, a high magnetic flux density could be obtained.

However, in the case where the C content was more than 0.05%, the residual C amount after the simultaneous decarburization-nitrogenization was more than 30 ppm, and therefore, if the materials were used on transformers, a magnetic aging would occur to aggravate the magnetic properties. Therefore it is seen that the C content should be preferably limited to 0.020–0.040%.

<Example 11>

Silicon steel slabs were prepared, and the slabs contained in weight %: 0.020% of C, 3.20% of Si, 0.24% of Mn, 0.019% of soluble Al, 0.0055% of N, 0.0033% of B, 0.005% of S, 0.015% of P, and a balance of Fe, with the contents of Cu, Ni and Cr being varied as shown in Table 11 below. The thickness of the slabs was 205 mm.

The slabs were heated at 1150° C. for 4 hours and 30 minutes, and a hot rolling was carried out to a thickness of 2.3 mm. Then an annealing was carried out at a temperature of 950° C. for 3 minutes, and then a pickling was carried out. Then, a single stage of cold rolling was carried out to a thicknesses of 0.285 mm. Then a simultaneous decarburization-nitrogenization annealing was carried out at 900° C. for 3 minutes under a mixed atmosphere containing wet 25% $N_2$+75% $H_2$(having a dew point of 45° C.) and a dry $NH_3$ gas, for forming the primary recrystallization structure.

In order to vary the N content of the steel sheet as shown in Table 11 below, ammonia ($NH_3$) of the atmospheric gas was varied within a range of 0.05–10 vol %, Hz was varied within a range of 5–80 vol %, and the rest was filled with $N_2$.

Then an annealing separator having a main ingredient MgO was spread on the steel sheets, and a final high temperature annealing was carried out based on a thermal cycle by raising the temperature up to 1200° C. at a rising rate of 20° C./hr under a 25% $N_2$+75% $H_2$ atmosphere, and by carrying out a soaking at 1200° C. for 15 hours under a 100% $H_2$ atmosphere.

For the specimens in which the additions of Cu, Ni and Cr and the content of N were varied, evaluations were made on the residual C amount, the total N content, the uniformness of the primary recrystallization structure after the simultaneous decarburization-nitrogenization annealing, the development of the secondary recrystallization, and the magnetic flux density. The evaluated results are shown in Table 11 below.

TABLE 11

| classification | alloy metals addition (wt %) Cu | Ni | Cr | optimum N range (ppm) | total N after D-N annealing (ppm) | residual C (ppm) | uniformness of primary recrystallization structure | Development of secondary recrystallization (%) | flux density $B_{10}$ (Tesla) |
|---|---|---|---|---|---|---|---|---|---|
| comparative material 27 | 0.5 | 0.05 | 0.05 | 125~269 | 122* | 26 | uniform | 95* | 1.88* |
| inventive material 43 | 0.5 | 0.05 | 0.05 | 125~269 | 220 | 24 | uniform | 100 | 1.95 |
| inventive material 44 | 0.5 | 0.05 | 0.05 | 125~269 | 265 | 22 | uniform | 100 | 1.95 |
| inventive material 45 | 0.5 | 0.05 | 0.05 | 125~269 | 233 | 19 | uniform | 100 | 1.96 |
| comparative material 28 | 0.5 | 0.05 | 0.05 | 125~269 | 280* | 14 | non-uniform* | 80* | 1.77* |
| inventive material 46 | 0.4 | 0.06 | 0.07 | 125~322 | 311 | 17 | uniform | 100 | 1.94 |
| inventive material 47 | 0.6 | 0.03 | 0.04 | 125~223 | 204 | 21 | uniform | 100 | 1.95 |
| inventive material 48 | 0.5 | 0.04 | 0.04 | 125~223 | 220 | 25 | uniform | 100 | 1.97 |
| comparative material 29 | 0.3 | 0.03 | 0.03 | 125~150 | 120* | 26 | uniform | 75* | 1.78* |
| inventive material 49 | 0.3 | 0.03 | 0.03 | 125~150 | 148 | 24 | uniform | 100 | 1.94 |
| comparative material 30 | 0.3 | 0.03 | 0.03 | 125~150 | 160* | 22 | non-uniform* | 95* | 1.88* |
| comparative material 31 | 0.7 | 0.07 | 0.07 | 125~449 | 123* | 28 | uniform | 70* | 1.75* |
| inventive material 50 | 0.7 | 0.07 | 0.07 | 125~449 | 430 | 14 | uniform | 100 | 1.97 |
| comparative material 32 | 0.7 | 0.07 | 0.07 | 125~449 | 460* | 13 | non-uniform* | 90* | 1.88* |
| comparative material 33 | 0.2* | 0.07 | 0.07 | 125~295 | 280 | 23 | non-uniform* | 85* | 1.82* |
| comparative material 34 | 0.5 | 0.02* | 0.05 | 125~202 | 190 | 20 | non-uniform* | 85* | 1.83* |
| comparative material 35 | 0.5 | 0.06 | 0.02* | 125~223 | 210 | 19 | non-uniform* | 90* | 1.87* |
| comparative material 36 | 0.8* | 0.04 | 0.04 | 125~295 | 290 | 45* | uniform | 100 | 1.86* |
| comparative material 37 | 0.5 | 0.04 | 0.08* | 125~322 | 308 | 46* | uniform | 100 | 1.84* |

*indicates cases where the conditions of the present invention are not conformed.

As shown in Table 11, in the cases of Inventive materials 43–50, the additions of Cu, Ni and Cr come within the ranges of the present invention, and the total N content comes within the range of $125-82.9\times\{1+[Cu\% +10\times(Ni\% +Cr\%)]^2\}$ppm. In these cases, a uniform primary recrystallization structure and proper size and amount of AlN precipitates were obtained. Thus the secondary recrystallization was perfect, and its orientation was superior, with the result that the magnetic flux densities were superior.

On the other hand, in the cases of the Comparative materials 27, 29 and 31 in which the total N content after the simultaneous decarburization-nitrogenization annealing was less than 125 ppm. In these cases, adequate inhibiting forces could not be obtained, and therefore, the secondary recrystallization was unstable, with the result that the magnetic flux densities were aggravated.

Further, even if the total N content was controlled to the range of the present invention, if any one of the additions of Cu, Ni and Cr came short of the range of the present invention (as in Comparative materials 33–35), then the primary recrystallization structure became non-uniform, and therefore, the secondary recrystallization became unstable, with the ultimate result that the magnetic flux densities were low.

Further, in the cases of Comparative materials 36 and 37 in which the additions of Cu and Cr exceeded the ranges of the present invention, although the secondary recrystallization was perfect, the decarburization was aggravated (the residual C exceeding 30 ppm), and the orientation was degraded. Consequently, superior magnetic properties could not be obtained.

<Example 12>

A silicon steel slab was prepared, and the slab contained in weight %: 0.036% of C, 3.10% of Si, 0.014% of Al, 0.10% of Mn, 0.0033% of B, 0.0030% of N, 0.0052% of S, 0.5% of Cu, 0.05% of Ni, 0.05% of Cr, and a balance of Fe and other unavoidable impurities.

The slab was heated at 1200° C. for 2 hours, and a hot rolling was carried out to a thickness of 2.3 mm. Then an annealing was carried out at a temperature of 900° C. for 2 minutes, and then an air cooling was carried out. Then a pickling was carried out, and then, a cold rolling was carried out to a thicknesses of 0.30 mm.

Then the methods of decarburization and nitrogenization were examined in three different ways. That is, as shown in Table 12 below, in one of them, the decarburization and the nitrogenization were carried out simultaneously (Inventive material 51). In another, the nitrogenization was carried out after the decarburization (Comparative material 38). In still another, the additional decarburization and the nitrogenization were carried out simultaneously after a primary slight decarburization (Comparative material 39).

Then an annealing separator MgO was spread on the steel sheets, and a final high temperature annealing was carried out by raising the temperature up to 1200° C. at a rising rate of 15° C./hr under a 25% $N_2$+75% $H_2$ atmosphere, and by maintaining at 1200° C. for 10 hours under a 100% $H_2$ atmosphere.

Then the residual C contents and the residual N contents after the simultaneous decarburization-nitrogenization annealing, the oxide layers of the specimens, the status of the glass film, the magnetic properties of the specimens were measured, and the results are shown in Table 12 below.

The thickness of the oxide layer was measured by observing the cross section of the specimens by means of an optical microscope after polishing and etching it with a nitric acid.

TABLE 12

| classification | annealing method | annealing conditions | residual C (ppm) | total N (ppm) | thickness of oxide layer (μm) | status of glass film | $B_{10}$ (Tesla) |
|---|---|---|---|---|---|---|---|
| inventive material 51 | simultaneous D-N | 850° C. × 180 seconds, Dew point: 50° C., 25% $N_2$ + 75% $H_2$ + 0.5% $NH_3$ | 15 | 180 | 2 | adequate | 1.95 |
| comparative material 38 | nitrogenization after decarburization | Decarburization: 850° C. × 180 seconds, Dew point: 50° C., wet 25% $N_2$ + 75% $H_2$ Nitrogenization: 750° C. × 70 seconds, dry 25% $N_2$ + 75% $H_2$ + 3% $NH_3$ | 16 | 120 | 8 | unacceptable | 1.90 |
| comparative material 39 | nitrogenization and decarburization after primary slight decarburization | Slight decarburization: 850° C. × 120 seconds, Dew point: 50° C., 25% $N_2$ + 75% $H_2$ Additional decarburization & nitrogenization: 850° C. × 70 seconds, dry 25% $N_2$ + 75% $H_2$ + 1% $NH_3$ | 15 | 125 | 6 | acceptable | 1.92 |

As shown in Table 12 above, in the steel in which B, Cu, Ni and Cr were added together according to the present invention, if the decarburization and nitrogenization were carried out simultaneously (as in Inventive material 51), then an oxide layer was formed in a proper thickness, and the aiming total N content could be attained. Therefore, the magnetic flux density was superior.

On the other hand, if the nitrogenization was carried out after the decarburization (as in Comparative material 38), or if additional decarburization and nitrogenization were carried out after a primary slight decarburization (as in Comparative material 39), then the oxide layer became too thick, and therefore, the control of the nitrogenization was difficult. Consequently, the secondary recrystallization became unstable, with the result that the magnetic flux density was relatively aggravated.

According to the- present invention as described above, not only a low temperature heating of the slab is possible, but also the nitrogenization can be carried out without modifying the existing facility, and the superior magnetic flux density can be obtained.

What is claimed is:

1. A method for manufacturing a grain oriented electrical steel sheet having a high magnetic flux density, comprising the steps of: providing a silicon steel slab of a selected composition; slab-heating and hot-rolling the silicon steel slab to form a hot-rolled steel sheet; annealing said hot-rolled steel sheet; cold-rolling said annealed steel sheet by a single stage to form a cold rolled steel sheet; decarburizing said cold rolled steel sheet; spreading an annealing separator on said decarburized steel sheet; and carrying out a final high temperature annealing;

wherein:

the selected composition of said silicon steel slab contains in weight % 0.02–0.045% of C, 2.90–3.30% of Si, 0.05–0.30% of Mn, 0.005–0.019% of Al, 0.003–0.008% of N, 0.006% or less of S, 0.30–0.70% of Cu, 0.03–0.07% Ni, 0.03–0.07% of Cr, and a balance of Fe and other unavoidable impurities;

the heating temperature for said steel slab is 1050–1250° C.; and the decarburization is carried out at a temperature of 850–950° C. for 340 seconds to 10 minutes under a nitrogen-containing atmosphere having a dew point of 30–70° C., to provide a residual C amount be 30 ppm or less, and to provide a total N amount be from 130 to $8.29\times\{1+[Cu\% +10\times(Ni\% +Cr\%)]^2\}$ ppm, whereby a low temperature heating method is realized.

2. The method as claimed in claim 1, wherein said steel slab has a thickness of 150–350 mm;

said hot rolled steel sheet has a thickness of 1.5–2.6 mm; and said cold rolled steel sheet has a thickness of 0.23–0.35 mm.

3. The method as claimed in claim 2, wherein said hot rolled steel sheet is annealed at a temperature of 900–1150° C. for 30 seconds to 10 minutes.

4. The method as claimed in claim 2, wherein the nitrogen-containing atmospheric gas for the decarburization consists of an ammonia+hydrogen+nitrogen mixed gas.

5. The method as claimed in claim 2, wherein the final high temperature annealing is carried out by raising a temperature to 1150–1250° C. at a rising rate of 10–40° C./hr under a dry hydrogen or mixed hydrogen-nitrogen atmosphere, and by carrying a soaking for 1–30 hours.

6. The method as claimed in claim 1, wherein said hot rolled steel sheet is annealed at a temperature of 900–1150° C. for 30 seconds to 10 minutes.

7. The method as claimed in claim 6, wherein the nitrogen-containing atmospheric gas for the decarburization consists of an ammonia+hydrogen+nitrogen mixed gas.

8. The method as claimed in claim 6, wherein the finish high temperature annealing is carried out by raising a temperature to 1150–1250° C. at a rising rate of 10–40° C./hr under a dry hydrogen or mixed hydrogen-nitrogen atmosphere, and by carrying a soaking for 1–30 hours.

9. The method as claimed in claim 1, wherein the nitrogen-containing atmospheric gas for the decarburization consists of an ammonia+hydrogen+nitrogen mixed gas.

10. The method as claimed in claim 9, wherein the final high temperature annealing is carried out by raising a temperature to 1150–1250° C. at a rising rate of 10–40° C./hr under a dry hydrogen or mixed hydrogen-nitrogen atmosphere, and by carrying a soaking for 1–30 hours.

11. The method as claimed in claim 1, wherein the final high temperature annealing is carried out by raising a temperature to 1150–1250° C. at a rising rate of 10–40° C./hr under a dry hydrogen or mixed hydrogen-nitrogen atmosphere, and by carrying a soaking for 1–30 hours.

12. A method for manufacturing a grain oriented electrical steel sheet having a high magnetic flux density, comprising the steps of: providing a silicon steel slab of a selected composition; slab-heating and hot-rolling the silicon steel slab to form a hot-rolled steel sheet; annealing said hot-rolled steel sheet; cold-rolling said annealed steel sheet by a single stage to form a cold rolled steel sheet; decarburizing said cold rolled steel sheet; spreading an annealing separator on said decarburized steel sheet; and carrying out a final high temperature annealing;

wherein:

the selected composition of said silicon steel slab contains in weight % 0.02–0.045% of C, 2.90–3.30% of Si, 0.05–0.30% of M, 0.001–0.012% of B, 0.005–0.019% of Al, 0.003–0.008% of N, 0.006% or less of S, 0.30–0.70% of Cu, 0.03–0.07% Ni, 0.03–0.07% of Cr, and a balance of Fe and other unavoidable impurities;

the heating temperature for said steel slab is 1050–1250° C.; and the decarburization is carried out at a temperature of 850–950° C. for 30 seconds to 10 minutes under a nitrogen-containing atmosphere having a dew point of 30–70° C. to provide a residual C amount be 30 ppm or less and to provide a total N amount be from 125 to $82.9\times\{1+[Cu\% +10\times(Ni\% +Cr\% )]^2\}$ ppm, whereby a low temperature heating method is realized.

13. The method as claimed in claim 11, wherein said steel slab has a thickness of 150–350 mm;

said hot rolled steel sheet has a thickness of 1.5–2.6 mm; and said cold rolled steel sheet has a thickness of 0.23–0.35 mm.

14. The method as claimed in claim 13, wherein said hot rolled steel sheet is annealed at a temperature of 900–1150° C. for 30 seconds to 10 minutes.

15. The method as claimed in claim 13, wherein the nitrogen-containing atmospheric gas for the decarburization consists of an ammonia+hydrogen+nitrogen mixed gas.

16. The method as claimed in claim 13, wherein the final high temperature annealing is carried out by raising a temperature to 1150–1250° C. at a rising rate of 10–40° C./hr under a dry hydrogen or mixed hydrogen-nitrogen atmosphere, and by carrying a soaking for 1–30 hours.

17. The method as claimed in claim 12, wherein said hot rolled steel sheet is annealed at a temperature of 900–1150° C. for 30 seconds to 10 minutes.

18. The method as claimed in claim 17, wherein the nitrogen-containing atmospheric gas for the decarburization consists of an ammonia+hydrogen+nitrogen mixed gas.

19. The method as claimed in claim 17, wherein the final high temperature annealing is carried out by raising a temperature to 1150–1250° C. at a rising rate of 10–40° C./hr under a dry hydrogen or mixed hydrogen-nitrogen atmosphere, and by carrying a soaking for 1–30 hours.

20. The method as claimed in claim 12, wherein the nitrogen-containing atmospheric gas for the decarburization consists of an ammonia+hydrogen+nitrogen mixed gas.

21. The method as claimed in claim 20, wherein the final high temperature annealing is carried out by raising a temperature to 1150–1250° C. at a rising rate of 10–40° C./hr under a dry hydrogen or mixed hydrogen-nitrogen atmosphere, and by carrying a soaking for 1–30 hours.

22. The method as claimed in claim 12, wherein the final high temperature annealing is carried out by raising a temperature to 1150–1250° C. at a rising rate of 10–40° C./hr under a dry hydrogen or mixed hydrogen-nitrogen atmosphere, and by carrying a soaking for 1–30 hours.

* * * * *

UNITED STATES PATENT AND TRADEMARK OFFICE

CERTIFICATE OF CORRECTION

PATENT NO. : 6,451,128 B1
DATED : September 17, 2002
INVENTOR(S) : Chung San Lee et al.

It is certified that error appears in the above-identified patent and that said Letters Patent is hereby corrected as shown below:

Title page, Item [54] and Column 1, line 2,
"DENSHY" should read -- DENSITY --.

Column 2,
Line 3, "sheet In" should read -- sheet. In --.

Column 6,
Line 49, "limited to 0.3-0.1%" should read -- limited to 0.3-0.7% --.

Column 8,
Line 67, "$\{1+[CuT+10x(Ni\%+Cr\%)]^2\}$ ppm" should read
-- $\{1+[Cu\%+10x(Ni\%+Cr\%)]^2\}$ ppm --.

Column 10,
Line 48, "Yamanakil's" should read -- Yamanaki's --.
Line 67, "other compounds" should read -- Other compounds --.

Column 11,
Before line 11, insert -- Further, the use of BN as the inhibitor brings additional advantages as follows. --.
Line 39, "contained 30 in" should read -- contained in --.

Column 14,
Table 2 Fourth Column Heading "Development of recystallization" should read
-- Development of secondary recrystallization --.

Column 16,
Table 4 Column 1 Fourth Row "inventive material 18" should read -- comparative material 18 --.
Table 4 Column 1 Last Row "inventive material 19" should read -- comparative material 19 --.
Line 50, "0 2.3" should read -- 2.3 --.

Column 17,
Line 35, "15°C,/hr" should read -- 15° C./hr --.

UNITED STATES PATENT AND TRADEMARK OFFICE

CERTIFICATE OF CORRECTION

PATENT NO. : 6,451,128 B1
DATED : September 17, 2002
INVENTOR(S) : Chung San Lee et al.

It is certified that error appears in the above-identified patent and that said Letters Patent is hereby corrected as shown below:

Column 18,
Line 42, <Example 5>“ should read -- <Example 8> --.
Line 55, “NH3” should read -- $NH_3$ --.

Column 19,
Table 8 First Column Last Row “inventive material 23” should read -- comparative material 23 --.
Line 24, “of Sr” should read -- of S, --.
Line 25, “of Cr.” should read -- of Cr, --.
Line 42, “$10^6$% $H_2$” should read -- 100% $H_2$ --.
Line 65, “together,.” should read -- together, --.

Column 20,
Line 21, “Hz atmosphere” should read -- $H_2$ atmosphere --.

Column 21,
Line 11, “Hz was” should read -- $H_2$ was --.

Column 22,
Line 55, “to a thicknesses” should read -- to a thickness --.

Column 23,
Line 52, “the- present” should read -- the present --.

Column 24,
Line 38, “amount be” should read -- amount of -- (first occurrence).
Line 39, “amount be” should read -- amount of -- (second occurrence).

Column 25,
Line 30, “of M” should read -- of Mn --.
Lines 40 and 41, “amount be” should read -- amount of --.

UNITED STATES PATENT AND TRADEMARK OFFICE

CERTIFICATE OF CORRECTION

PATENT NO. : 6,451,128 B1
DATED : September 17, 2002
INVENTOR(S) : Chung San Lee et al.

It is certified that error appears in the above-identified patent and that said Letters Patent is hereby corrected as shown below:

Column 26,
Line 1, "claim 11" should read -- claim 12 --.

Signed and Sealed this

Twenty-ninth Day of April, 2003

JAMES E. ROGAN
*Director of the United States Patent and Trademark Office*